US005905484A

United States Patent [19]

Verhulst

[11] Patent Number: 5,905,484

[45] Date of Patent: May 18, 1999

[54] LIQUID CRYSTAL DISPLAY DEVICE WITH CONTROL CIRCUIT

[75] Inventor: Antonius G. H. Verhulst, Eindhoven, Netherlands

[73] Assignee: U.S. Philips Corporation, New York, N.Y.

[21] Appl. No.: 08/718,809

[22] Filed: Sep. 24, 1996

[30] Foreign Application Priority Data

Sep. 25, 1995 [EP] European Pat. Off. ..... 95202573

[51] Int. Cl.[6] ..... G09G 3/36

[52] U.S. Cl. ..... 345/98; 345/97

[58] Field of Search ..... 345/98, 100, 99, 345/87, 88, 89, 90, 91, 92, 93, 94, 95, 96, 97, 101, 211, 208, 209, 210, 206

[56] References Cited

U.S. PATENT DOCUMENTS

| | | | |
|---|---|---|---|
| 4,621,260 | 11/1986 | Suzuki et al. | 340/719 |
| 5,119,085 | 6/1992 | Yamazaki | 345/89 |
| 5,315,396 | 5/1994 | Miyadera | 345/98 |
| 5,600,345 | 2/1997 | Dingwall et al. | 345/100 |
| 5,621,439 | 4/1997 | Okada et al. | 345/100 |
| 5,701,136 | 12/1997 | Huq et al. | 345/100 |

FOREIGN PATENT DOCUMENTS

0607860A1 7/1994 European Pat. Off. .

OTHER PUBLICATIONS

"A Full–Color DHF–AMLCD with Wide Viewing Angle" in SID 94 Digest, pp. 430–433.

J.S. Patel: "Ferroelectric Liquid Crystal Modulator using Twisted Smectic Structure", Appl. Phys. Lett. vol. 60(3) pp. 280–282 (1992).

H. Okada et al: "New Display Mode of Ferroelectric Liquid Crystals with Large Tilt Angle", Ferroelectrics vol. 149, 171–181 (1993).

D.M. Walba et al: High Performance Electroclinic Materials, Ferroelectrics vol. 148, 435–442 (1993).

*Primary Examiner*—Xiao Wu

*Attorney, Agent, or Firm*—John C. Fox

[57] ABSTRACT

In liquid crystal display devices based on smectic LC material having a high polarization (Deformed Helix FLC, twisted FLC, monostable FLC, electroclinic smectic A LC and antiferroelectric LC), the memory effect in, for example, monitor or video applications is eliminated by presenting compensation voltages in matrix displays based on MIMs, TFTs or diodes, dependent on the data in a previous frame, so that the polarization within a cell always switches to the correct value.

11 Claims, 7 Drawing Sheets

LIQUID CRYSTAL DISPLAY DEVICE WITH CONTROL CIRCUIT

BACKGROUND OF THE INVENTION

The invention relates to a display device comprising a plurality of pixels arranged in the form of a matrix in rows and columns, with a liquid crystal material from the group of smectic liquid crystal materials comprising ferroelectric liquid crystal material having a deformable helix, ferroelectric liquid crystal material having a twisted smectic structure, monostable ferroelectric liquid crystal material, electroclinic smectic A liquid crystal material and antiferroelectric liquid crystal material between a first substrate and a second substrate, and further comprising a group of row electrodes and a group of column electrodes, each pixel on at least one substrate comprising a picture electrode which is connected to a column electrode or row electrode via an active switching element, the display device comprising means for presenting selection voltages to the row electrodes and data voltages to the column electrodes.

Display devices of this type are applicable as video displays (for example, in projection systems) but also, for example, in datagraphic monitors, or as viewfinders.

A display device of the type mentioned above is described in "A Full-Color DHF-AMLCD with Wide Viewing Angle" in SID 94 Digest, pp. 430–433. The use of devices with DHFLC material (Deformed Helix Ferroelectric Liquid Crystal) is described in this article as being advantageous with respect to SSFLC devices (Surface Stabilized Ferroelectric Liquid Crystal) due to the lack of multidomains, while grey scales can be better realized due to a more continuous change of the transmission/voltage characteristic. In spite of the fast switching time which is mentioned for the mixture used in the display device, the frame frequency remains, however, too low for video applications (NTSC or PAL). Moreover, image sticking (after images) also occurs in the device described in this article.

OBJECTS AND SUMMARY OF THE INVENTION

It is an object of the invention to provide a display device of the type described in the opening paragraph, which can operate at frame frequencies of more than 20 Hz (for example, 50 Hz (PAL)).

It is another object of the invention to provide a device in which there is little or no after-image.

To this end, a display device according to the invention is characterized in that the display device comprises a control circuit for compensating the voltage amplitude of the data signal voltage, at least a part of the compensation being determined by the data signal during a previous drive period.

In this connection, the drive period is understood to mean a recurrent period within which the display cells are provided with selection signals. In addition, correction of the data voltage is possible (for example, for temperature variations).

The invention is based on the recognition that when the voltage is applied across a pixel, the spontaneous polarization in said LC materials and the switching time of the material play such a role that either such a long time is necessary that the display device as a whole becomes too slow, or the pixel does not acquire the desired charge and the associated transmission value. The above-mentioned article proposes to give a row of pixels first an auxiliary voltage (reset) prior to selection, but also in that case the pixel does not always acquire the desired charge due to the important role of the spontaneous polarization, so that an incomplete reset occurs. Since the charge (and hence the transmission value) across the pixel is undefined again after this reset, the data signal then applied at a subsequent selection will lead to a different final value of the charge (and hence the transmission value) across the pixel than was intended, and so forth. Even at the same grey scale of the pixel to be written in a period lasting several frame periods, it may take several frame periods before this "memory effect" is eliminated. This effect notably occurs when the presented signal changes (grey level change).

In a display device according to the invention, the "memory effect" is at least substantially completely eliminated because the data signal (and hence the associated polarization and transmission value) of a pixel as applied during a previous drive period (frame), is used via the control circuit for compensating the voltage amplitude of the presented data signal. The data voltage thereby determined is then actually composed of a reset component and a data component, with the reset component being determined by the polarization associated with the transmission value due to the data voltage presented during a previous drive period (frame).

The same problems occur in other liquid crystal effects having a large spontaneous polarization, whose value increases with the electric field. The transmission/voltage characteristic for positive and negative voltages is then usually symmetrical. Examples of such effects are described in

- J. S. Patel: "Ferroelectric Liquid Crystal Modulator using Twisted Smectic Structure", Appl. Phys. Lett. Vol. 60(3) pp. 280–282 (1992)
- H. Okada et al.: "New Display Mode of Ferroelectric Liquid Crystals with Large Tilt Angle", Ferroelectrics Vol. 149, 171–181 (1993),
- D. M. Walba et al.: "High Performance Electroclinic Materials", Ferroelectrics Vol. 148, 435–442 (1993).

Another example is the anti-ferroelectric liquid crystal effect.

A first preferred embodiment of a display device according to the invention is characterized in that the data signal voltage is inverted during successive drive periods, and in that, with an increasing voltage amplitude of the data signal with respect to the voltage amplitude of the data signal during the previous drive period, the control circuit decreases the voltage amplitude of the data signal to a value between the voltage amplitude of the data signal during the drive period and the voltage amplitude of the data signal during the previous drive period, and, with a decreasing voltage amplitude of the data signal with respect to the data voltage during the previous drive period, increases the voltage amplitude of the data signal to a value between the voltage amplitude of the drive signal during the drive period and the voltage amplitude of the drive signal during the previous drive period.

Since the voltage amplitudes of the selection voltages for the different frames are usually identical, only a memory for the data signal voltages is required in this embodiment. By inverting, problems due to the build-up of DC voltages across the cell are prevented.

To determine the correction of the voltage amplitude, the display device comprises, for example, a microprocessor or a look-up table in which an extra correction can be computed (or fixed at a one-time base) in a simple manner for, for example temperature variations.

If the active switching element is, for example, a TFT, each pixel may be provided with an extra capacitor. The charge stored on the extra capacitor during the selection period (which may now be much shorter) also determines the charge across the pixel (and hence the polarization).

Another embodiment is characterized in that the active switching element is a TFT on the first substrate, and the control circuit comprises means for inverting the voltage of a counter electrode located on the second substrate at every drive period. In this case, lower drive voltages and hence cheaper control circuits are sufficient.

These and other aspects of the invention will be apparent from and elucidated with reference to the embodiments described hereinafter.

BRIEF DESCRIPTION OF THE DRAWINGS

In the drawings:

FIG. 7 is an equivalent circuit diagram of a part of another device according to the invention, while

DETAILED DESCRIPTION OF THE PREFERRED EMBODIMENTS

Figure 1:
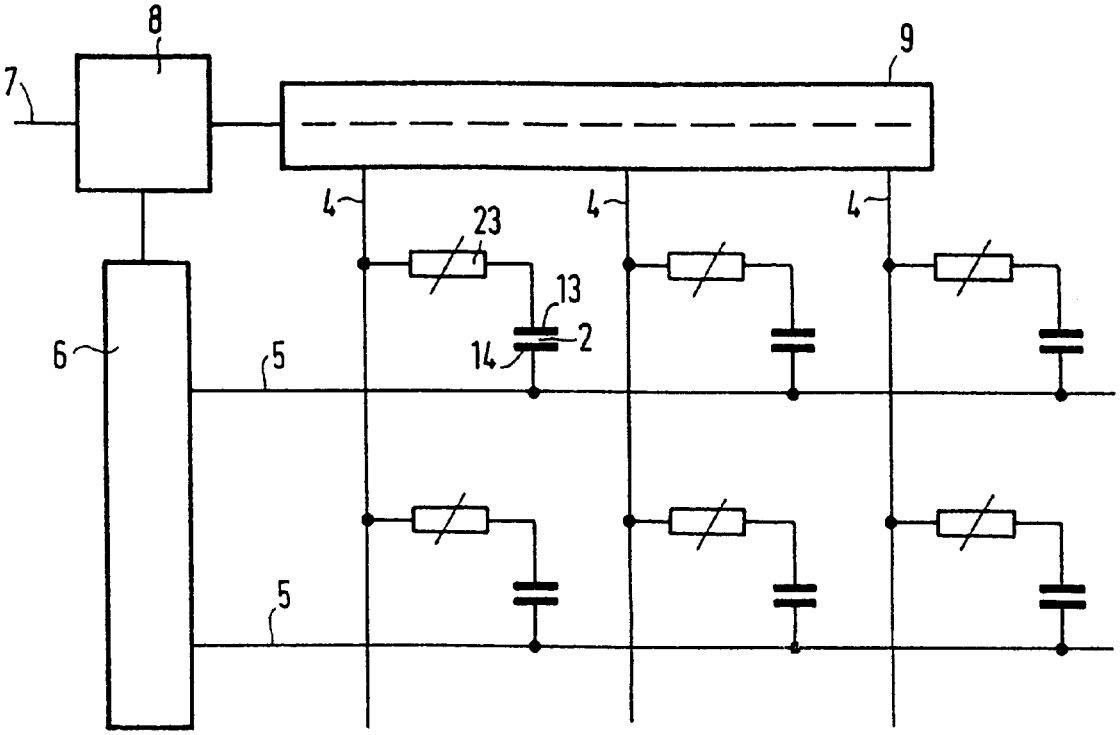
FIG. 1 is an equivalent circuit diagram of a part of a display device according to the invention.

FIG. 1 is an equivalent circuit diagram of a part of a display device 1. This device comprises picture elements or pixels 2 arranged in rows and columns. In this embodiment, the pixels 2 are connected to column or data electrodes 4 via two-pole switches, here MIMs 23. A row of pixels is selected via row or selection electrodes 5 which select the relevant row. The row electrodes 5 are successively selected by means of a multiplex circuit 6.

After possibly having been processed in a processing/drive unit 8, incoming information 7 is stored in a data register 9. The data voltages presented by the data register 9 cover a voltage range which is sufficient to set the desired grey levels. Pixels 2 are then charged during selection, dependent on the voltage difference between the picture electrodes 13, 14 and the duration of the information-determining pulse. The picture electrodes 14 constitute a common row electrode 5 in this embodiment.

Figure 6:
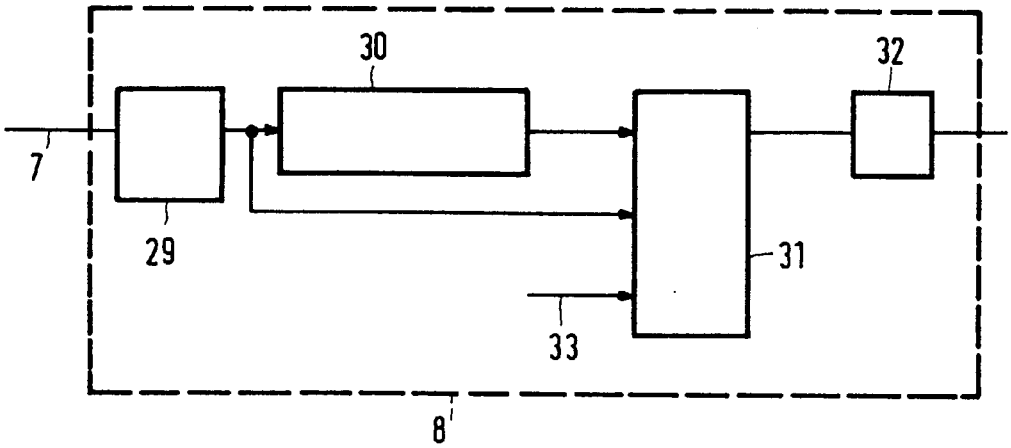
FIG. 6 is an equivalent circuit diagram of a part of the device of FIG. 1.

To prevent that new picture information is written in a delayed manner due to charge of a previous (sub-)frame which is still present on the pixels, the incoming data signal 7 may be adapted in the processing unit 8 to be described hereinafter, which will be further elucidated with reference to FIG. 6.

The use of the active switching elements prevents signals at the column electrodes for other pixels from influencing the adjustment of the voltage across the pixels before these pixels are again selected (in a subsequent (sub-)frame).

Figure 2:
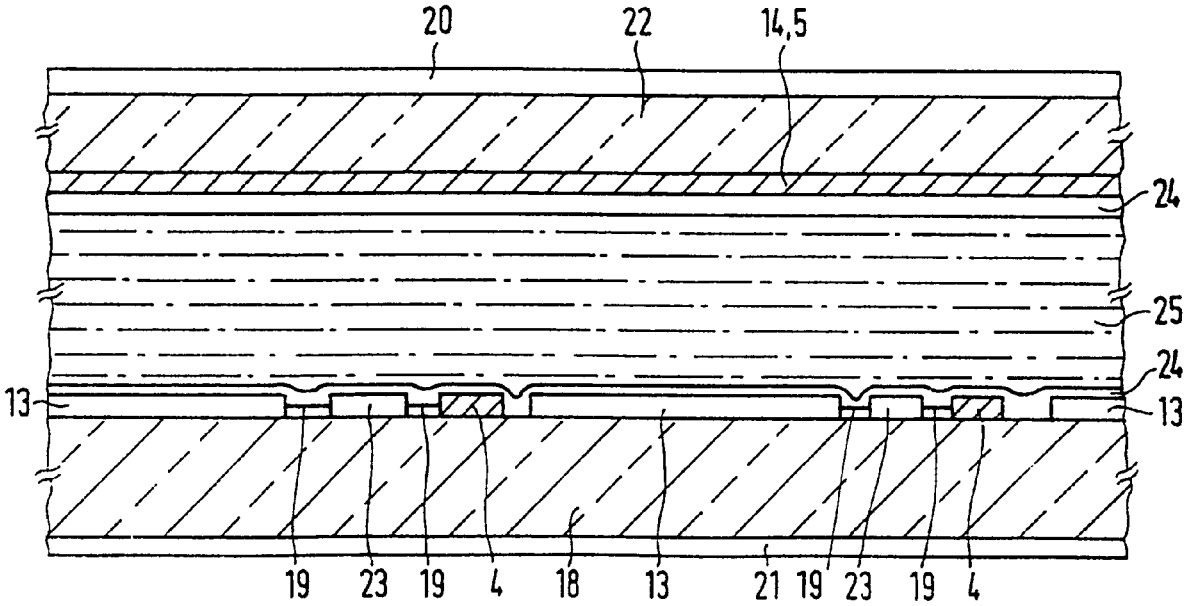
FIG. 2 is a diagrammatic cross-section of the device of FIG. 1.

FIG. 2 is a diagrammatic cross-section of the device shown in FIG. 1. A first substrate 18 is provided with column electrodes 4 and picture electrodes 13, in this embodiment of a transparent conducting material, for example, indium tin oxide which are connected to the column electrodes 4 via the MIMs 23 by means of connections 19 (shown diagrammatically).

A second substrate 22 is provided with picture electrodes 14 which are integrated to common row or selection electrodes 5 in this embodiment. The two substrates are also coated with orienting layers 24, while a ferroelectric liquid crystal material having a deformable helix 25 is present between the substrates in this embodiment. Possible spacers and the sealing edge are not shown. The device also comprises a first polarizer 20 and a second polarizer or analyzer 21 whose axes of polarization cross each other perpendicularly.

Figure 3A:
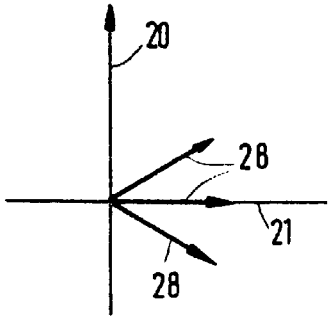
FIG. 3 shows diagrammatically the position of the polarizers with respect to the helix (FIG. 3*a*) and the transmission/voltage characteristic (FIG. 3*b*) of a device according to the invention.
Figure 3B:
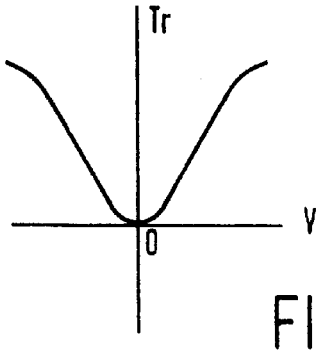

FIG. 3 shows diagrammatically a transmission/voltage characteristic (FIG. 3*b*) of a cell in such a device, in which in the absence of the electric field, the axis of the helix (and hence the optical axis 28) of the DHFLC material is chosen to be parallel to one of the polarizers (see FIG. 3*a*), which is referred to as the symmetrical mode. Due to an applied electric voltage across the cell, the molecules attempt to direct their spontaneous polarization towards the associated field; between crossed polarizers with the axis of the helix parallel to one of the polarizers, this leads to a transmission/voltage characteristic which for both positive and negative voltages exhibits an increasing transmission upon an increase of the voltage (FIG. 3*b*). However, the invention is also applicable in the asymmetrical mode, in which the crossed polarizers are rotated with respect to the cell in such a way that the optical axis of the helix of the DHFLC material in the driven state coincides with one of the polarization directions.

Figure 4A:
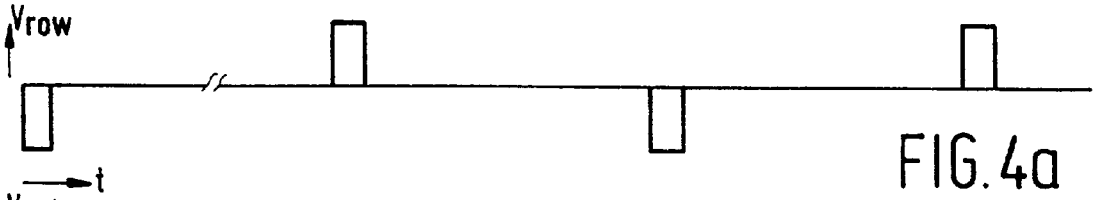
FIG. 4 shows diagrammatically some voltage waveforms and the associated polarization and transmission curves for the device of FIG. 1 driven by means of a known method.
Figure 4B:
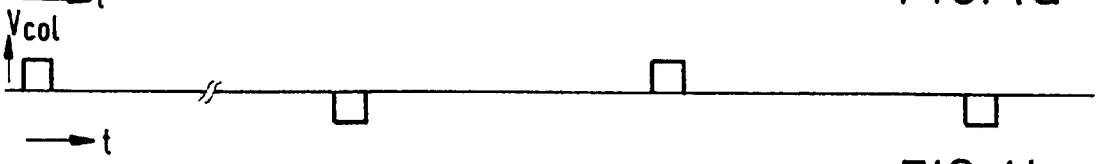

To prevent unwanted charge effects, the cell of the device of FIGS. 1, 2 is preferably driven with voltages having an alternating sign. FIG. 4*a* shows the voltage waveform at a selection electrode 5 and FIG. 4*b* shows the voltage waveform at a column electrode 4.

Figure 4C:
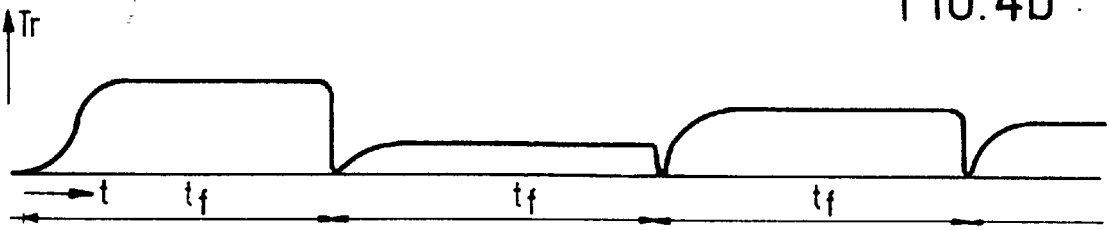
Figure 4D:
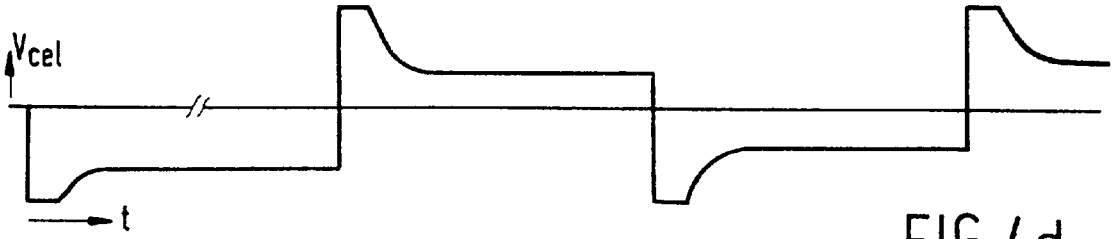
Figure 4E:
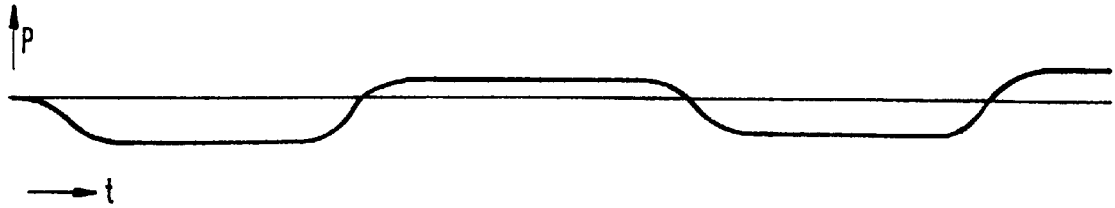

FIG. 4*c* shows the resultant transmission. This Figure shows that at a fixed transmission value T to be set, and apart from short periods of zero transmission, said transmission reaches the ultimate transmission value T in several (here at least 4) switching periods via a number of intermediate values which are both below and above this value, which is completely in contradistinction to the expectation based on the high switching rate of the DHFLC material. The cause of this effect should be found in the high value of the spontaneous polarization of these materials. Moreover, the conventional pulse duration of the pulses at the electrodes 13, 14 (in practice, for example, 64 $\mu$sec in TV systems) is too short for supplying the polarization current (i.e. for completely switching the polarization). After selection, the cell having cell capacitance $C_0$ has a voltage of, for example $V_0$, which corresponds to a charge $Q=C_0.V_0$. During the subsequent non-selection period (corresponding, in TV systems, to the rest of a frame period) the charge supplies the polarization current (or a part thereof) still to be supplied. Consequently, the voltage across the pixel decreases, as is shown in FIG. 4*d*. If voltages changing sign occur across the pixel, not only polarization of the previous setting should be eliminated upon each setting operation, but also the polarization associated with the new transmission value should be set. Due to the symmetrical, alternating drive, this results after 3 to 4 drive periods (or sometimes even more) in a substantially symmetrical variation of the voltage and hence of the polarization about the abscissa, as is shown in FIG. 4*e*. The transmission is subsequently substantially constant (for constant drive voltages).

The waiting time before the ultimate transmission state is reached upon a change of incoming information 7 is, however, unacceptably long. According to the invention, this waiting time is decreased by correcting the data voltages upon a change of the incoming information. Correction of the data voltages upon a change of temperature is also possible.

The invention is based on the recognition that, without any special measures, the successive data and selection voltages cause the polarization of the cell to change its sign from always different (absolute) values. As a result, the transmission of the cell also alternates so that it relaxes to a final value. By taking into account this variation of the absolute value of the polarization upon a change of the transition value in determining the voltage amplitude of the new data voltage to be presented, the desired transmission value is reached rapidly (usually within one drive period).

FIG. 5 shows a number of drive signals, namely the selection voltages for the row electrodes 5 (FIG. 5*a*) and the data voltages for the column electrodes 4 (FIG. 5*b*) in which (solid lines) the invention is realized for the device of FIGS. 1, 2. The amplitudes of the data pulses (and the polarization) are identical in the first two frame periods ($t_{f1}$, $t_{f2}$) but of opposite sign (frame inversion). During the third frame ($t_{f3}$) a different data value is used, with which a different, in this case larger, polarization value is associated. This polarization, which is shown in FIG. 5*c*, should acquire the absolute value $P_2$ (when the information afterwards remains the same). To prevent the above-mentioned oscillations in the voltage across the display cell (and the polarization and transmission), the data signal is corrected during $t_{f3}$ in such a way that the desired values of cell voltage and polarization are obtained already during this frame period. The amplitude change of data signals received in successive frames is processed in the data voltage presented (to the column electrodes 4) in such a way that the polarization (which is $P_1$ and $-P_1$ during $t_{f1}$ and $t_{f2}$, respectively) immediately acquires substantially the value $P_2$. Since with an increasing amplitude of the data signal, which is assumed to remain equal during some drive periods, the polarization acquires a value $P_2$ after selection in the frame $t_{f4}$, this polarization changes upon selection during $t_{f3}$ by a value $|P_1|+|P_2|$ and upon selection during $t_{f4}$ by a value $|2P_2|$. Since $|P_1|<|P_2|$, the amplitude of the adapted data voltage during $t_{f3}$ is smaller than the amplitude of the adapted data voltage during $t_{f4}$.

Figure 5A:
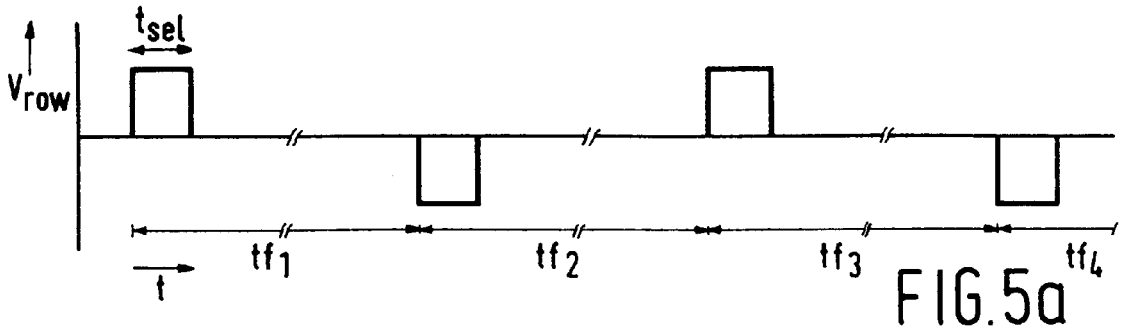
FIG. 5 shows diagrammatically the same as FIG. 4 when a method according to the invention is used.
Figure 5B:
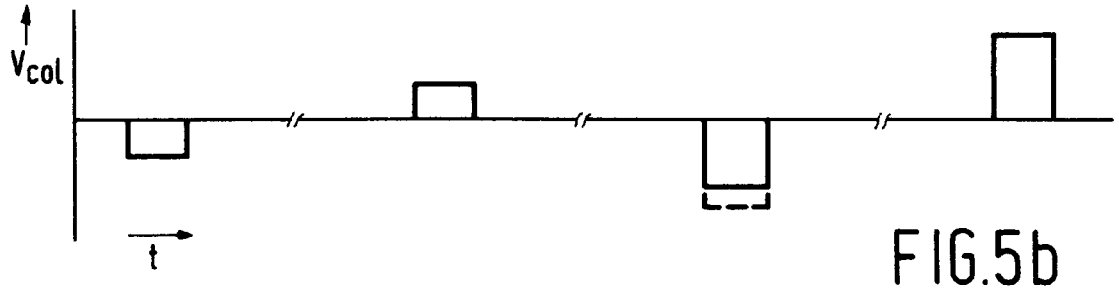
Figure 5C:
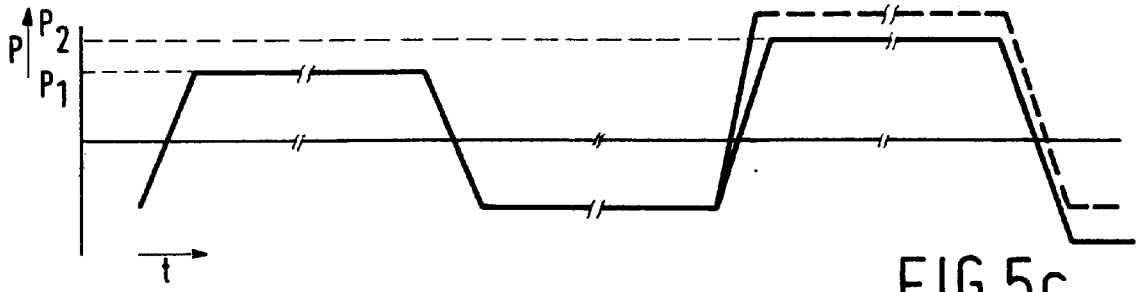
Figure 5D:
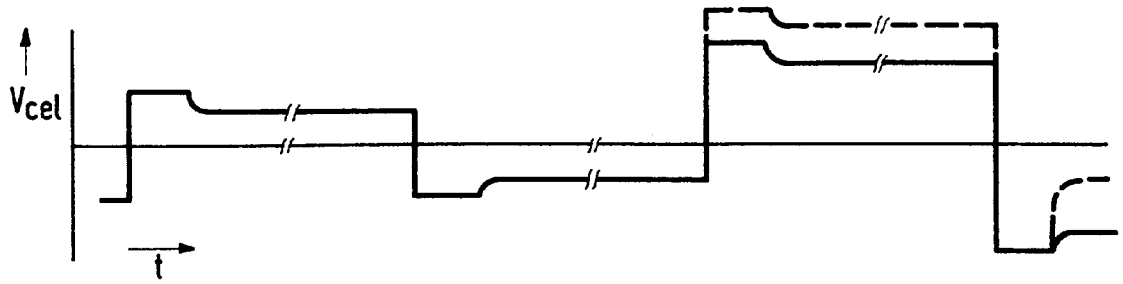
Figure 5E:
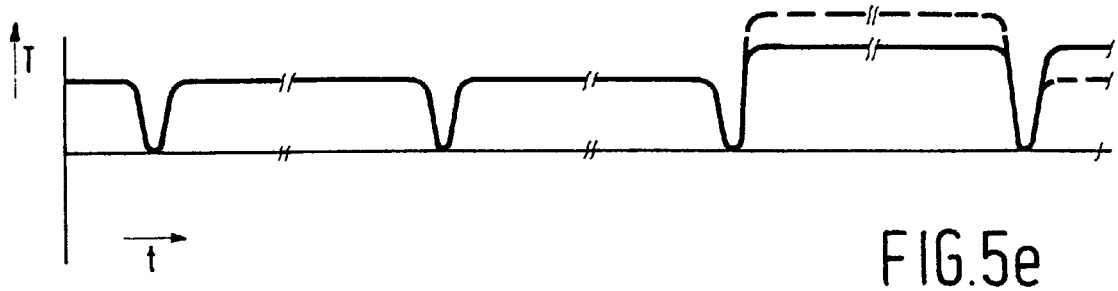

Since the polarization of previous frame periods is compensated at a varying data signal during selection, the desired (new) value of the voltage across the cell is reached immediately after selection, which new value now exclusively depends on the incoming signal 7. The above-mentioned memory effect is thereby eliminated. The associated voltages across the cell are shown in FIG. 5*d* and the associated transmission curve is shown in FIG. 5*e*. The broken lines in FIGS. 5*c*, 5*d*, 5*e* show the polarization, voltage and transmission curves without correction.

The compensation mode will be further described with reference to FIG. 6 in which a part of the processing unit 8 is shown. If necessary, incoming data or video signals 7 of a frame are converted into binary data via an A/D converter 29 and stored in a frame memory 30 (or a delay line) and simultaneously applied to the look-up table or computing unit/microprocessor 31. During writing of the frame memory 30, its contents are compared with those of the previous frame. The information supplied by the look-up table or computing unit 31 is thus determined in this case by the contents of two successive frames and converted by means of a D/A converter 32 into the correct voltages which are applied as data voltages to the column electrodes 4. Upon frame inversion and with an increasing amplitude of the data signal with respect to the amplitude of the data signal during the previous drive period, the amplitude of the data voltage is decreased, and upon a decreasing amplitude of the data signal with respect to the amplitude of the data signal during the previous drive period, the amplitude of the data voltage is increased in the manner as described hereinbefore.

Figure 7:
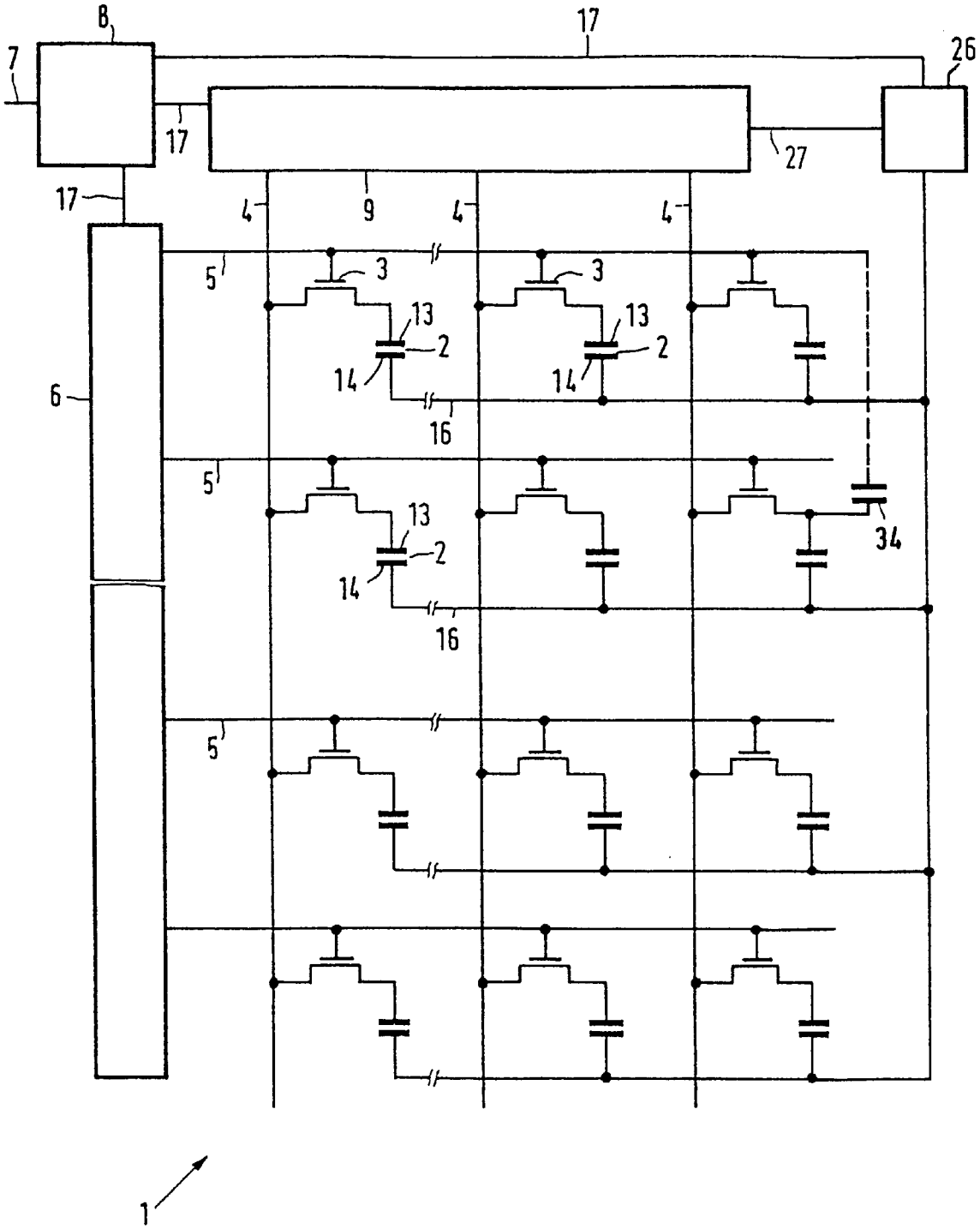
Figure 8A:
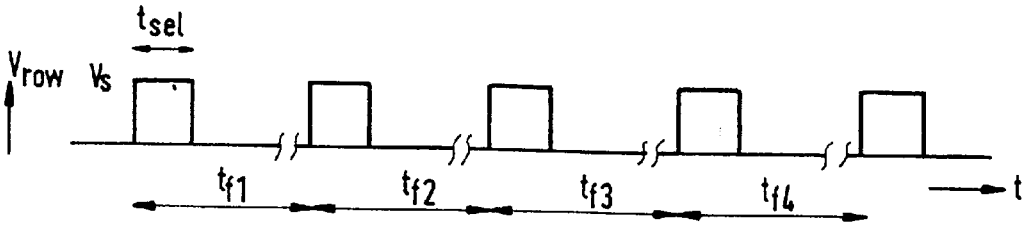
FIGS. 8 and 9 show the associated voltage waveforms and the associated polarization and transmission curves for the device of FIG. 7.
Figure 8B:
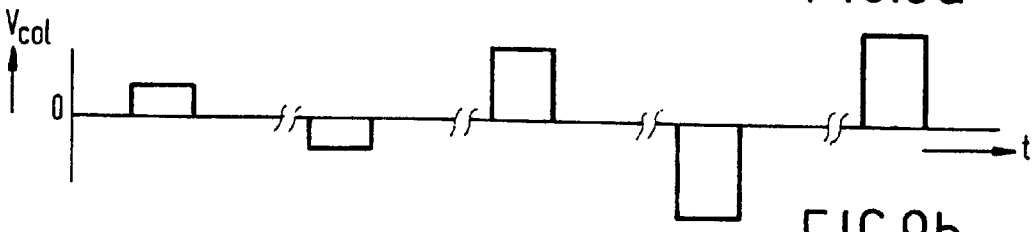
Figure 8C:
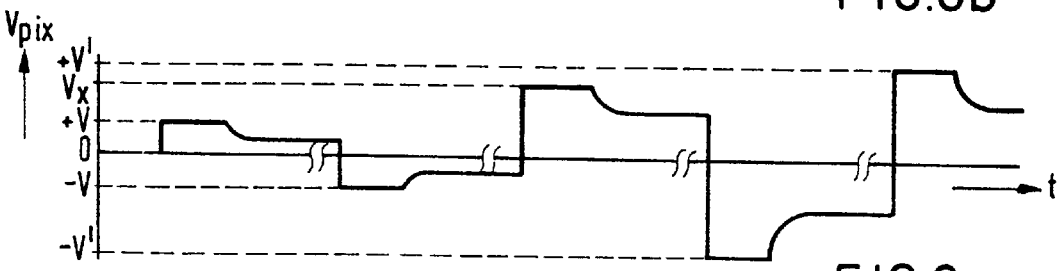
Figure 8D:
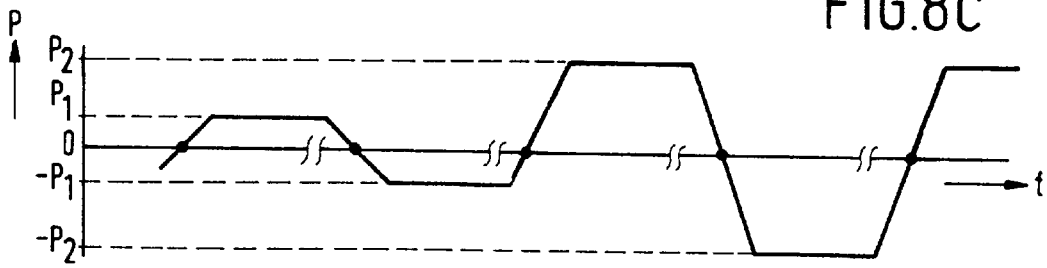
Figure 8E:
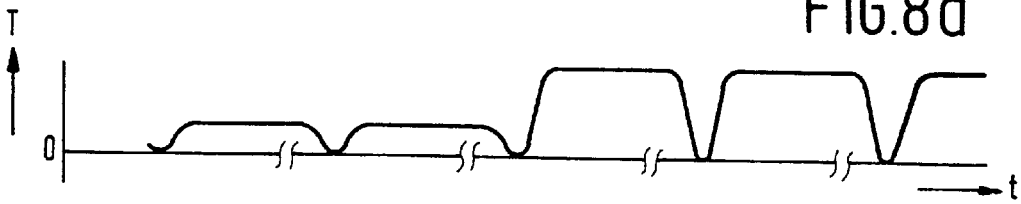
Figure 8F:
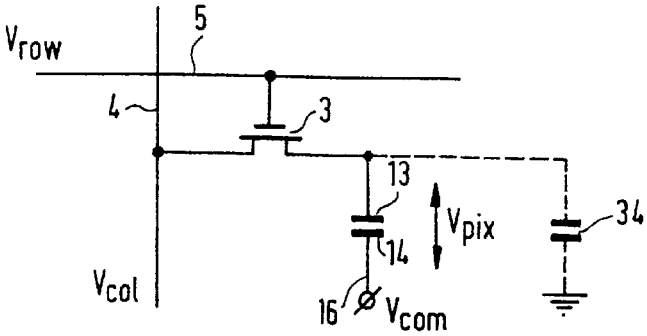
Figure 9A:
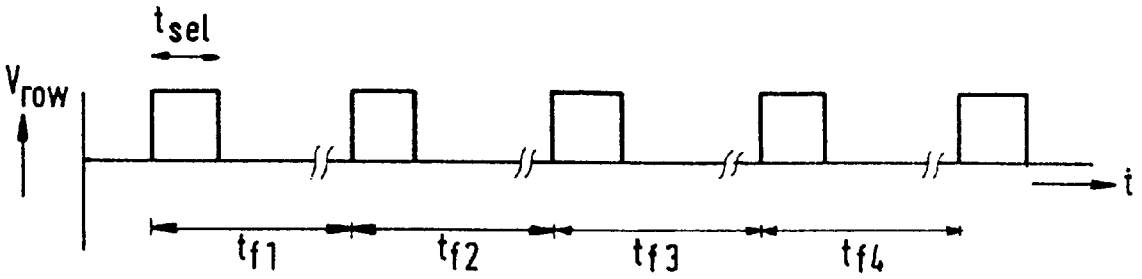
Figure 9B:
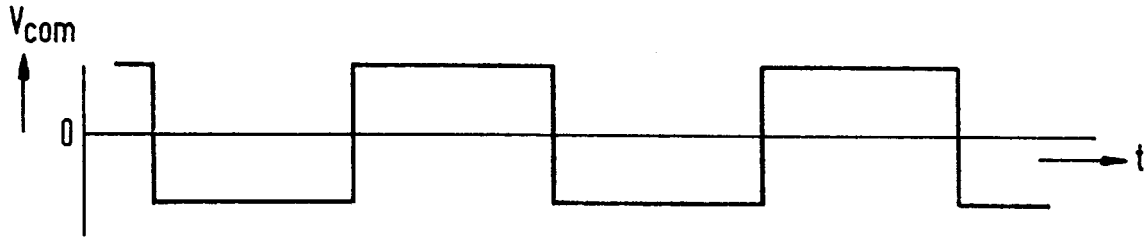
Figure 9C:
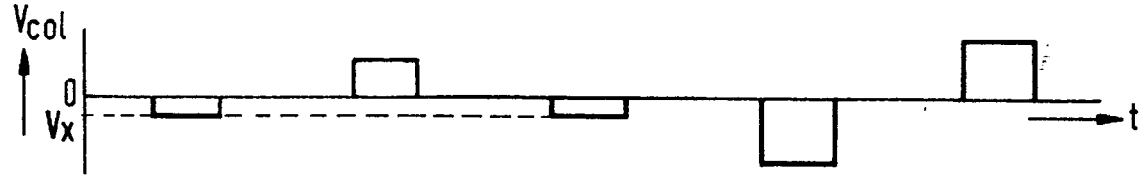
Figure 9D:
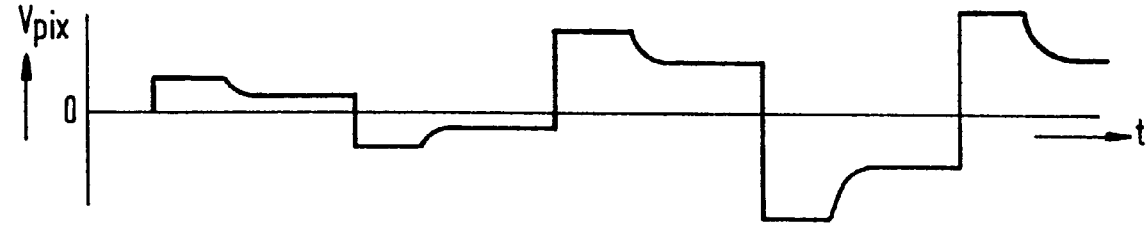

FIG. 7 is an equivalent circuit diagram of a part of another display device 1. This device also comprises a matrix of pixels 2 arranged in rows and columns. In this embodiment, the pixels 2 are connected via three-pole switches, thin-film transistors (TFTs) 3 in this embodiment, to column or data electrodes 4. A row of pixels is selected via row or selection electrodes 5 which select the relevant row via the gate electrodes of the TFTs. The row electrodes 5 are successively selected by means of a multiplex circuit 6.

Incoming data signals or (video) information 7 are also processed in a processing/control unit 8 as described with reference to the previous embodiment, and stored in a data register 9. Pixels 2, here represented by means of capacitors, are positively or negatively charged via the TFTs 3 in that the picture electrodes 13 take over the voltage of the column electrodes during selection. In this embodiment, the picture electrodes 14 constitute a common counter electrode which is denoted by the reference numeral 16.

The associated voltage waveforms as well as the polarization and transmission curves are shown in FIG. 8. FIG. 8*a* shows the selection pulses during successive frame periods $t_f$. At the start of the frame period $t_{f3}$, when the polarization changes from $-P_1$ to $P_2$, a compensated voltage $V_x$ is used instead of the data voltage V' which realizes the polarization $|P_2|$ during later drive periods (FIG. 8*d*). FIGS. 8*c* and 8*e* also show the associated voltages across the cell and the transmission curve.

A variant of FIG. 8 is shown in FIG. 9. The counter electrode 16 is now provided with an alternating voltage $V_{com}$ (FIG. 9*b*), while selection voltages are presented during selection by means of the row electrodes (FIG. 9*a*). In this way, smaller column voltages are sufficient (FIG. 9*c*), while the same voltage variation $V_{pix}$ as in FIG. 8 is obtained across the pixel. In the embodiments shown in FIGS. 8 and 9, an extra capacitance 34 may be used advantageously, as is shown by means of broken lines in FIGS. 7 and 8*f*. Since these are rapidly charged during selection, and the stored charge substantially determines the correct state of polarization during non-selection, the selection period (line period) may be short, for example <10 μsec, so that the device is suitable for (video) applications at high frame frequencies.

Figure 10:
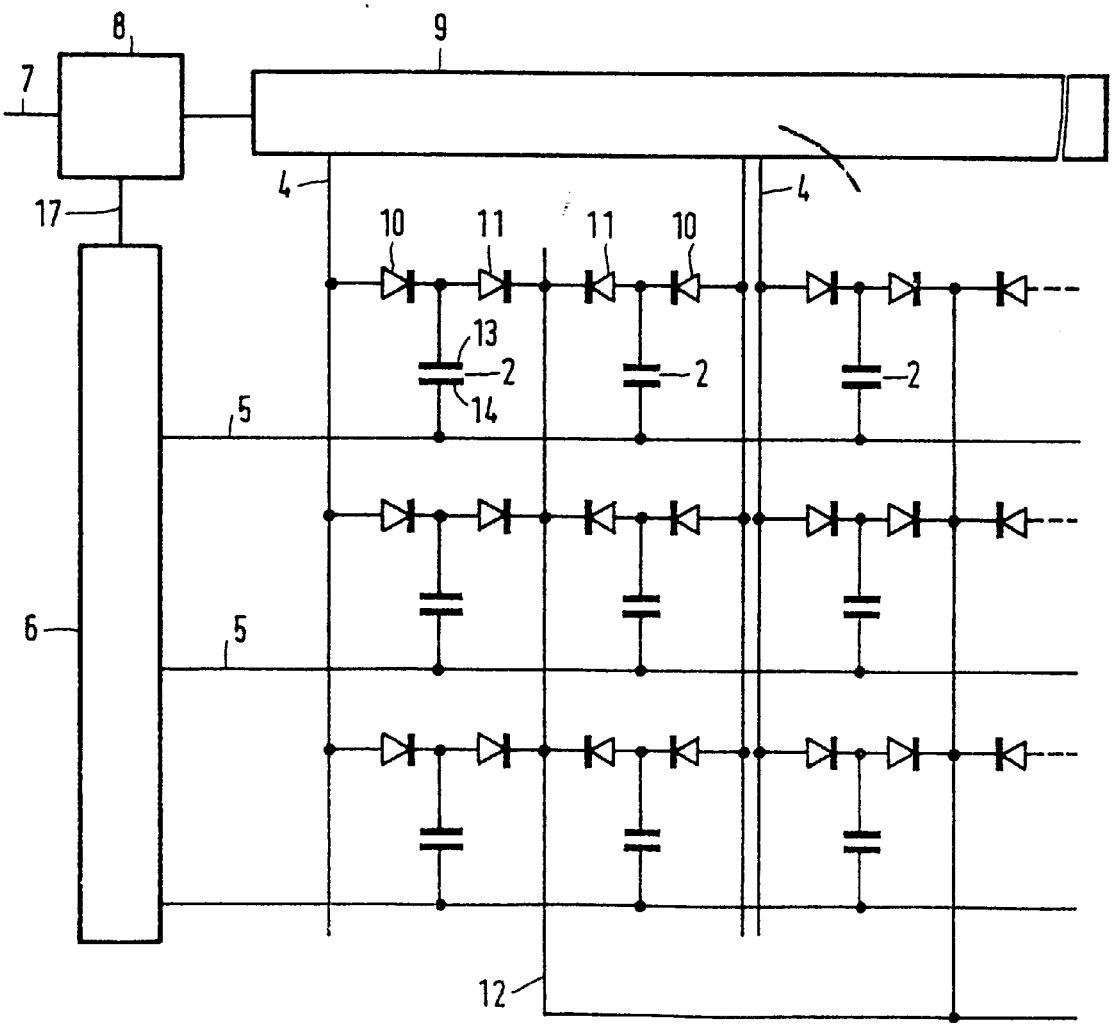
FIG. 10 shows yet another device according to the invention.

FIG. 10 is an equivalent circuit diagram of a part of a display device using diodes. Of each pixel 2, which is now formed by picture electrodes 13, 14 arranged on facing substrates, the picture electrode 13 is connected in this embodiment to a column electrode 4 via a diode 10 and to a line 12 for a common reference voltage via a second diode 11. The picture electrode 14 of each pixel is connected to a row electrode 5, while several picture electrodes in a row may be integrated to form one row electrode. In this circuit diagram, the data voltages can also be corrected in the same way as described with reference to FIGS. 1, 5, so that the correct polarization value is immediately adjusted upon a change of the data signal.

The invention is of course not limited to the embodiments shown, but several variations are possible within the scope of the invention. For example, both reflective and transmissive display devices may be used.

The invention is also applicable to liquid crystal systems other than those based on DHFLC, such as the above-mentioned effects (ferroelectric LCD with a twisted smectic structure, monostable FLCD, electroclinic smectic A LCD, and anti-ferroelectric LCD).

In summary, the invention provides the possibility of eliminating the memory effect in video applications in liquid crystal display devices having a high polarization of the LC material (notably DHFLC, twisted FLC, monostable FLC, electroclinic smectic A and anti-ferroelectric LC) by presenting compensation voltages in matrix displays based on MIMs or TFTs or diodes, dependent on the data in a previous frame, so that the polarization within a cell always switches to the correct value.

I claim:

1. A display device comprising a plurality of pixels arranged in the form of a matrix in rows and columns, with a liquid crystal material from the group of smectic liquid crystal materials comprising ferroelectric liquid crystal material having a deformable helix, ferroelectric liquid crystal material having a twisted smectic structure, monostable ferroelectric liquid crystal material, electroclinic smectic A liquid crystal material and anti-ferroelectric liquid crystal material between a first substrate and a second substrate, and further comprising a group of row electrodes and a group of column electrodes, each pixel on at least one substrate comprising a picture electrode which is connected to a column electrode or row electrode via an active switching element, the display device comprising means for presenting selection voltages to the row electrodes and data voltages to the column electrodes, characterized in that the display device comprises a control circuit for compensating the voltage amplitude of the data signal, at least a part of the compensation being determined by the data signal during a previous drive period.

2. A display device as claimed in claim 1, characterized in that the control circuit changes the data voltage only when the amplitude of the data signal voltage changes with respect to the amplitude of the data signal voltage during the previous drive period.

3. A display device as claimed in claim 2, characterized in that the data signal voltage is inverted during successive drive periods and in that, with an increasing voltage amplitude of the data signal with respect to the voltage amplitude of the data signal during the previous drive period, the control circuit decreases the voltage amplitude of the data signal voltage to a value between the voltage amplitude of the drive signal during the drive period and the voltage amplitude of the drive signal during the previous drive period, and, with a decreasing voltage amplitude of the data signal with respect to the voltage amplitude of the data signal during the previous drive period, increases the voltage amplitude of the data signal to a value between the voltage amplitude of the date signal during the drive period and the voltage amplitude of the data signal during the previous drive period.

4. A display device as claimed in claim 1, characterized in that the control circuit comprises a microprocessor or a look-up table.

5. A display device as claimed in claim 4, characterized in that the microprocessor or the look-up table also compensates for temperature variations.

6. A display device as claimed in claim 1, characterized in that the drive periods are frame periods.

7. A display device as claimed in claim 1, characterized in that the active switching element is a TFT, and each pixel is provided with an extra capacitor.

8. A display device as claimed in claim 1, characterized in that the active switching element is a TFT on the first substrate, and the control circuit comprises means for inverting the voltage of a counter electrode on the second substrate at every drive period.

9. A display device as claimed in claim 2, characterized in that the drive periods are frame periods.

10. A display device as claimed in claim 2, characterized in that the active switching element is a TFT, and each pixel is provided with an extra capacitor.

11. A display device as claimed in claim 2, characterized in that the active switching element is a TFT on the first substrate, and the control circuit comprises means for inverting the voltage of a counter electrode on the second substrate at every drive period.

* * * * *